United States Patent [19]

Staerzl et al.

[11] Patent Number: 4,922,866

[45] Date of Patent: May 8, 1990

[54] FUEL INJECTOR ASSEMBLY

[75] Inventors: Richard E. Staerzl; Ronald D. Stageman, both of Fond du Lac, Wis.

[73] Assignee: Brunswick Corporation, Skokie, Ill.

[21] Appl. No.: 357,003

[22] Filed: May 25, 1989

[51] Int. Cl.[5] ..... F24C 1/16; F02M 35/10

[52] U.S. Cl. ..... 123/73 A; 123/470

[58] Field of Search ..... 123/73 R, 73 A, 73 V, 123/52 M, 445, 470

[56] References Cited

U.S. PATENT DOCUMENTS

| | | | |
|---|---|---|---|
| 3,472,211 | 10/1969 | Meininger | 123/73 R |
| 4,227,492 | 10/1980 | Haase | 123/73 R |
| 4,244,332 | 1/1981 | Kusche et al. | 123/73 R |
| 4,305,351 | 12/1981 | Staerzl | 123/73 A |
| 4,359,975 | 11/1982 | Heidner | 123/73 R |
| 4,389,982 | 6/1983 | Boyesen | 123/73 R |
| 4,763,626 | 8/1988 | Staerzl | 123/73 A |
| 4,770,131 | 9/1988 | Tuckey | 123/73 A |

*Primary Examiner*—David A. Okonsky

*Attorney, Agent, or Firm*—Lockwood, Alex, Fitzgibbon & Cummings

[57] ABSTRACT

A fuel injector assembly and a low pressure fuel injection system incorporating the fuel injector assembly are provided. The fuel injector assembly includes a fastener housing that functions to secure a reed valve block to a mounting plate which separates the air intake manifold from the crankcase of the internal combustion engine. A fuel injector or check valve is secured to the fastener housing so that fuel directed to the fuel injector passes through the mounting plate and into the crankcase at a location in the vicinity of the air flow outlet from the reed valve block.

18 Claims, 2 Drawing Sheets

FUEL INJECTOR ASSEMBLY

BACKGROUND AND SUMMARY OF THE INVENTION

The present invention generally relates to an improved injector assembly for a fuel injection system, as well to a fuel injection system incorporating the assembly. More particularly, the invention relates to fuel injection systems, particularly low pressure fuel injection systems, for internal combustion engines that incorporate one or more reed block assemblies having reed valves which substantially permit a one-way flow of air into the crankcase of the internal combustion engine. The fuel injector assembly also serves to securely mount the reed block assembly to its desired location within the internal combustion engine.

One-way reed valves and the like are known to be incorporated within internal combustion engines. The reed valves often are mounted in a bank or block-like arrangement in the form of a reed valve block assembly which is secured to a wall or the like of the engine in a manner such that the reed valves provide one-way passageways into the crankcase of the internal combustion engine. These passageways provide access of at least air into the engine crankcase while preventing backflow out of the crankcase and facilitating vacuum or low pressure conditions in a chamber or manifold upstream of the reed valve assembly.

In some internal combustion engines, the fuel is also injected into the chamber or manifold upstream of the reed valves. In an arrangement of this type, the intent is to atomize the fuel within the chamber, and the fuel and air mixture then flows through the various reed valves and into the crankcase for subsequent passage into a cylinder for combustion in accordance with generally known principles. One intended advantage of this type of an arrangement is that the fuel will automatically lubricate the petals of the reed valves. However, this type of an arrangement is not without its disadvantages. By passing the fuel through the reed valves, there is a tendency for the fuel to deposit within the reed valve assembly and thereby form a gum, which can reduce engine efficiency and cause an engine maintenance problem, especially when the engine is not used for extended time periods. This can lead to engine starting difficulties and can require periodic cleaning. Even in the absence of any substantial gumming, it has been determined that flowing fuel through the reed valve reduces the flow volume of air therethrough and can cause a reduction in the air which is available to flow to the cylinders. This reduction in total potential air flow volume through the reed valve banks generally translates into a loss of total potential horsepower that can be developed by the internal combustion engine.

Some internal combustion engines include arrangements that are designed to avoid problems created by passing the fuel through the reed valve bank. Publications such as Staerzl U.S. Pat. Nos. 4,305,351 and 4,763,626, the subject matter thereof being incorporated by reference hereinto, show low pressure electronic fuel injection systems wherein the fuel is injected directly into the crankcase at a location downstream of the outlet from the reed valve bank assembly. An approach such as this is also intended to minimize the development of a so-called puddling condition, which is prone to develop in the case of an outboard motor wherein cylinders are in a vertically stacked array.

With vertically stacked cylinders, there is a tendency, due the influence of gravity, for the lower cylinders to receive a greater flow of fuel than do the upper cylinders, which can result in unduly enriched fuel-air mixtures in the lower cylinder or cylinders. Such a so-called puddling condition creates inefficiencies and impairs the ability of the engine to achieve its designed output.

Although devices such as these have made substantial progress in avoiding the so-called puddling condition, they too are not without disadvantages. For each fuel outlet downstream of the reed valve bank, an opening must typically be made through the engine block or crankcase wall. This increases manufacturing costs and gives rise to a potential maintenance requirement to ensure proper positioning of the injectors within the cylinder block or crankcase wall. In addition, this type of an arrangement requires fuel lines running to each injector at locations external of the engine. This type of fuel routing is considered to be aesthetically unpleasing due to the numerous external fuel lines connected to the various injectors downstream of the reed valve bank.

By the present invention, at least one fuel injection outlet is provided at a location adjacent to or immediately downstream of each reed valve block of an internal combustion engine. This is accomplished without having to pass each injector and/or fuel line through the engine block or crankcase wall of the internal combustion engine. In the apparatus according to the present invention, a fuel injector assembly is provided which also serves as a securement member for a reed valve block. Multiple fuel injector assemblies can be provided for each reed valve block that opens into the crankcase of the engine. Each fuel injector assembly includes a fuel injector or check valve which is supported by a fastener housing that also functions as a fastener mount by which a reed valve block is attached to the engine.

It is a general object of the present invention to provide an improved fuel injector assembly and a fuel injection system incorporating same.

Another object of this invention is to provide an improved fuel injector assembly which provides a fuel inlet site that opens into the crankcase of an internal combustion engine and by virtue of which fuel flow through reed valve blocks of the engine can be eliminated.

Another object of the present invention is to provide an improved low pressure fuel injection system for an internal combustion engine in which a fuel injector assembly thereof functions both as an injector and as a reed valve mounting device.

Another object of the present invention is to provide an improved fuel injector assembly which minimizes the likelihood that a puddling condition will develop, even in two-cycle multiple-cylinder engines for incorporation into marine outboard motors.

Another object of this invention is to provide a low pressure fuel injection system for an internal combustion engine which avoids aesthetically unattractive external fuel lines running to the engine block.

These and other objects, features and advantages of the present invention will be clearly understood through a consideration of the followed detailed description.

BRIEF DESCRIPTION OF THE DRAWINGS

In the course of this description, reference will be made to the attached drawings, wherein:

FIG. 3 is an enlarged, detailed view, partially in cross-section, of a fuel injector assembly according to the present invention.

DESCRIPTION OF THE PARTICULAR EMBODIMENTS

Figure 1:
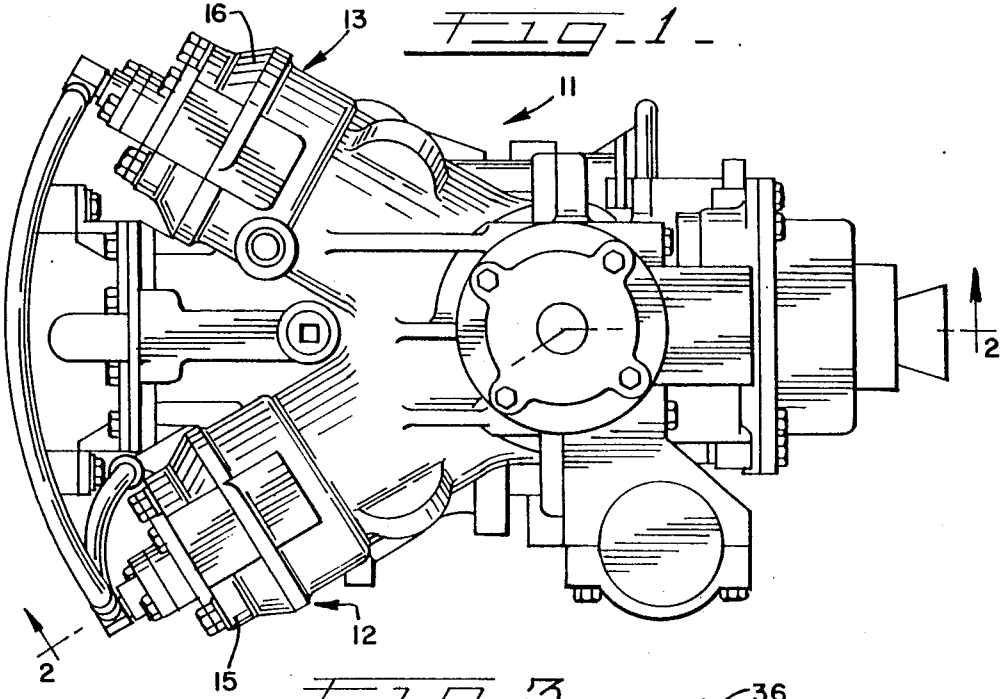
FIG. 1 is an end elevational view of a multiple-cylinder internal combustion engine of the type incorporated into marine outboard motors.
Figure 5:
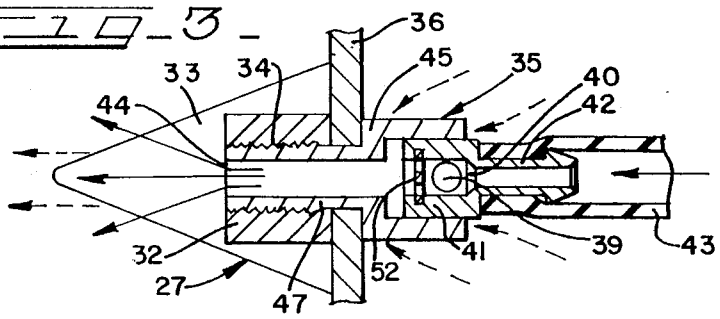

Referring first to FIG. 1, a two-cycle V-6 engine having two banks of three cylinders at 60° angular separation is generally designated as 11. Two banks of cylinders, generally designated as 12 and 13, are illustrated. An engine block 14 includes cylinder heads 15 and 16. While the overall construction of the engine 11 will be appreciate by those skilled in the art, further details are illustrated in FIG. 2.

Figure 2:
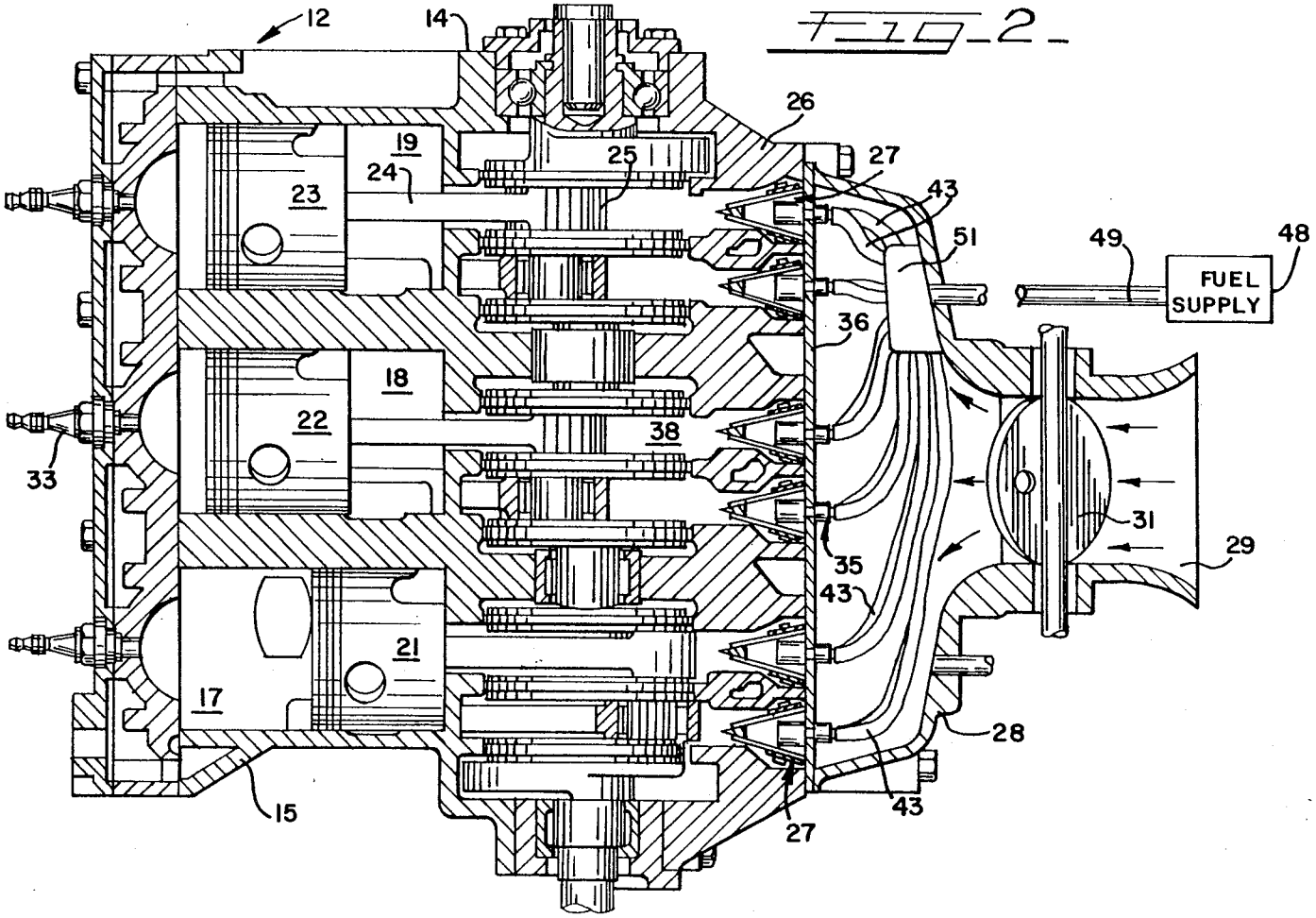
FIG. 2 is a cross-sectional view generally along the line 2—2 of FIG. 1 and illustrating a fuel injection system in accordance with the present invention.

As can be seen in FIG. 2, a plurality of cylinders 17, 18 and 19 are formed within the cylinder head 15, and pistons 21, 22 and 23, respectively, are mounted therewithin in the customary manner. Connecting rods 24 secure each piston to a crankshaft assembly 25 in a generally known manner. It will be observed that the crankshaft assembly 25 is generally vertically oriented, and the pistons 21, 22, 23 and the cylinders 17, 18, 19 are generally horizontally oriented such that they are vertically positioned with respect to each other and thus form a vertical array. Fuel/air supply block 26 supports a bank of one-way reed valve assemblies 27. An air intake manifold 28 is secured to the fuel/air supply block 26 and defines the air intake flow path as illustrated by the arrows.

Incoming air passes through a venturi 29 having a butterfly valve 31 for controlling the volume of air flowing into the air intake manifold 28. Air flowing through the venturi 29 is accelerated toward and passes through each reed valve assembly 27, after which the flowing air mixes with fuel entering the fuel/air supply block 26 in a manner discussed in more detail hereinafter in order to thereby provide the needed fuel and air mixture for passage to the cylinders 17, 18, 19 and for timed ignition by spark plugs 33 or the like in a generally well-known manner.

Figure 4:
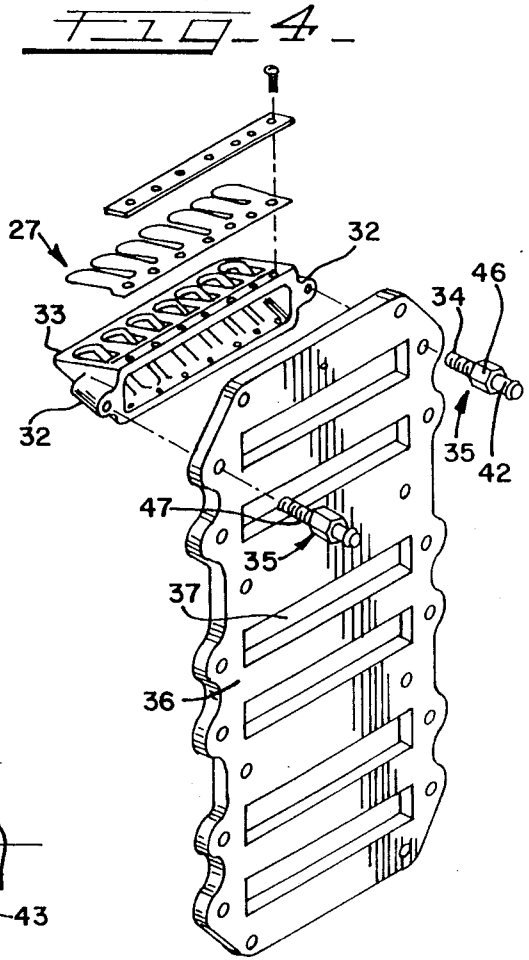
FIG. 4 is an exploded perspective view illustrating particular mounting features of the fuel injector assembly illustrated in FIGS. 2 and 3.

With more particular reference to the one-way reed valve assemblies 27, further details thereof are illustrated in FIGS. 3 and 4. A 14-petal reed valve block is illustrated in FIG. 4 in a partially exploded format. Details regarding the construction and operation of the reed valves are well-known. Each one-way reed valve block or assembly 27 is associated with at least one mounting component 32. The illustrated mounting component 32 is a boss secured to the block 33 supporting the petals. The illustrated mounting component 32 is internally threaded to facilitate secure fastening of the reed valve block 27, although other securement arrangements could be utilized if desired.

Corresponding securement components or arrangements, such as the illustrated external threads 34, are included on fuel injector assemblies, generally designated as 35. One or more fuel injector assembly 35 securely fastens each one-way reed valve assembly 27 to a mounting or adapter plate 36 or the like. Illustrated mounting plate 36, which divides the air intake manifold 28 from the fuel/air supply block 26, is designed to support a horizontal array of reed valve blocks, and it will be appreciated that vertical arrays are also possible. Passageways 37 through the mounting plate 36 permit air entering through the venturi 29 to pass from the air intake manifold 28 and through each one-way reed valve assembly 27 that is secured over the passageway 37. Upon passing through the one way reed valve assembly 27, the air enters crankcase 38 for subsequent flow, together with fuel, into one of the cylinders 17, 18, 19.

Referring more specifically to each fuel injector assembly 35, each includes a check valve or fuel injector 41. Valve or injector 41 is of a generally known construction for permitting the desired flow of fuel therethrough in the direction of the solid arrows as shown in FIG. 3. Preferably, each valve or injector 41 includes a valve ball 39 and a valve seat 40. A retainer 52 is also provided upstream of the valve ball 39. Each injector 41 also has a suitable connection member, such as the illustrated nipple fitting 42, for receiving and securely holding an internal fuel line branch 43 which, when provided, conveys fuel directly into the valve or injector 41. The thus injected fuel exits the fuel injector assembly 35 through an outlet orifice 44.

Each fuel injector assembly 35 further includes a fastener housing 45. The housing 45 securely holds the check valve or injector 41 in a manner such that the fuel will pass from the nipple fitting 42 to the outlet orifice 44, preferably through a generally straight and unobstructed flow path. Fastener housing 45 includes means for securing the one-way reed valve block assembly 27 to mounting plate 36 or the like. In the illustrated embodiment, this is accomplished by providing the fastener housing 45 with an external configuration approximating that of a mounting bolt, the illustrated embodiment including a "hex" head 46 and a hollow shaft 47 having the external threads 34 which mate with the internal threads of the mounting component 32 associated with the reed valve block 33. The illustrated fuel injector assemblies 35 are designed to function as mounting bolts; for example, each should be capable of withstanding a torque wrench application force of at least about 60 pounds-inch.

In the illustrated embodiment, a plurality of internal fuel line branches 43 are provided, with each fuel line branch 43 channeling fuel from a fuel supply 48 to its respective fuel injector assembly 35. Preferably, fuel supply 48 includes components of a low pressure fuel injection system for an internal combustion engine, including components such as a fuel tank, a fuel pump, one or more solenoid valves and a fuel line 49. Each of these components is of a generally known construction. A fuel rail or manifold 51 is provided in order to distribute the fuel flowing through fuel line 49 to the various internal fuel line branches 43 which run to each fuel injector assembly 35. Other suitable arrangements could be made, as desired, for transmitting fuel from the fuel supply 48 to each fuel injector assembly 35.

Whatever fuel directing arrangement is utilized, fuel exits from the outlet orifice 44 of each fuel injector assembly 35 at a location that is closely adjacent to the outlets from the respective one-way reed valve assemblies 27. Efficient fuel and air mixing is accomplished, and all or a substantial portion of such mixing is carried out at a location downstream of the outlets from the one-way reed valve assemblies 27. In this regard, an example of typical air flow into and out of the reed valve assembly 27 is shown by broken arrows in FIG. 3.

It will be understood that the embodiments of the present invention which have been described are illustrative of some of the applications of the principles of the present invention. Numerous modifications may be made by those skilled in the art without departing from the true spirit and scope of the invention.

We claim:

1. A fuel injector assembly for a low pressure fuel injection system of an internal combustion engine, the fuel injector assembly comprising:

check valve means for receiving a flow of fuel from a fuel supply system and for transmitting the fuel into a crankcase of an internal combustion engine, said check valve means including an inlet end and an outlet end;

fastener housing means for supporting said check valve means and for securing a reed valve block assembly to a location at which the reed valve block assembly opens into the crankcase of the internal combustion engine; and a hollow passageway in said fastener housing means, said fastener housing means hollow passageway receiving said check valve means, whereby the flow of fuel from said outlet end of the check valve means is directed into the crankcase of the internal combustion engine.

2. The fuel injector assembly according to claim 1, wherein said fastener housing means is a bolt-like member, and said hollow passageway of said fastener housing means has a longitudinal axis that is coaxial with a longitudinal axis of said check valve means.

3. The fuel injector assembly according to claim 1, wherein said fastener housing means includes external thread means for engaging internal thread means of a mounting component associated with the reed valve block assembly.

4. The fuel injector assembly according to claim 1, wherein said fuel injector assembly receives a flow of fuel from a fuel passageway of the fuel supply system.

5. The fuel injector assembly according to claim 4, wherein said fuel passageway is a fuel line positioned within an air intake manifold of the internal combustion engine, and wherein said fuel injector assembly includes a fitting for receiving said fuel line.

6. The fuel injector assembly according to claim 1, wherein a bored boss is associated with the reed valve block assembly, and wherein said fastener housing means is within and generally coaxial with the bored boss.

7. The fuel injector assembly according to claim 6, wherein the bored boss has a threaded bore, and said fastener housing means has external threads which threadedly engage the threaded bore.

8. The fuel injector assembly according to claim 1, wherein an adapter plate between the crankcase and an air intake manifold of the internal combustion engine supports said fastener housing means which secures the reed valve block assembly to the adapter plate.

9. The fuel injector assembly according to claim 1, wherein said outlet end of the fuel injector assembly is generally adjacent to an outlet of the reed valve block assembly.

10. A low pressure fuel injection system for an internal combustion engine, the fuel injection system comprising:

fuel supply means for providing a flow of fuel to a crankcase which is upstream of a cylinder of an internal combustion engine;

a fuel injector assembly at a downstream end location of said fuel supply means, said fuel injector assembly including an inlet opening and an outlet opening;

check valve means of said fuel injector assembly for transmitting the flow of fuel into the crankcase, said check valve means including an inlet end and an outlet end;

said fuel injector assembly further including fastener housing means for supporting said check valve means and for securing a reed valve block assembly to a location at which the reed valve block assembly opens into the crankcase; and said fastener housing means includes a hollow passageway which receives said check valve means, whereby the flow of fuel from said outlet opening of the fuel injector assembly is directed into the crankcase.

11. The fuel injection system according to claim 10, further including fuel line means connecting said fuel supply means to said inlet opening of the fuel injector assembly, and at least a portion of said fuel line means is within an air intake manifold of the internal combustion engine.

12. The fuel injection system according to claim 11, further including means for introducing a flow of air into the air intake manifold, whereby said flow of air passes through the reed valve block assembly prior to mixing with fuel from the fuel line means, and wherein air flows out of said reed valve block assembly at an outlet thereof which is generally adjacent to the outlet opening of said fuel injector assembly, said outlet opening of the fuel injector assembly being within the crankcase of the internal combustion engine.

13. The fuel injection system according to claim 10, further including a mounting plate between the crankcase and an air intake manifold of the internal combustion engine, and wherein said fuel injector assembly provides means for mounting the reed valve block assembly to said mounting plate.

14. The fuel injection system according to claim 10, wherein said outlet opening of the fuel injector assembly is generally adjacent to an outlet of said reed valve block assembly.

15. The fuel injection system according to claim 10, wherein said fastener housing means is a bolt-like member, and said hollow passageway of said fastener housing means has a longitudinal axis that is coaxial with a longitudinal axis of said check valve means.

16. The fuel injection system according to claim 15, wherein said fastener housing means includes external thread means for engaging internal thread means of a mounting component associated with the reed valve block assembly.

17. A low pressure fuel injection system for an internal combustion engine, the fuel injection system comprising:

fuel supply means for providing a flow of fuel to a crankcase which is upstream of a cylinder of an internal combustion engine;

a fuel injector assembly at a downstream end location of said fuel supply means, said fuel injector assembly including an inlet opening and an outlet opening;

check valve means of said fuel injector assembly for transmitting the flow of fuel into the crankcase, said check valve means including an inlet end and an outlet end;

said fuel injector assembly further including fastener housing means for supporting said check valve means and for securing a reed valve block assembly to a location at which the reed valve block assembly opens into the crankcase, said fastener housing means including a hollow passageway which receives said check valve means, whereby the flow of fuel from said outlet opening of the fuel injector assembly is directed into the crankcase;

fuel line means connecting said fuel supply means to said inlet opening of the fuel injector assembly, and at least a portion of said fuel line means being within an air intake manifold of the internal combustion engine; and a mounting plate between the crankcase and an air intake manifold of the internal combustion engine, and wherein said fuel injector assembly provides means for mounting the reed valve block assembly to said mounting plate.

18. The system according to claim 17, further including means for introducing a flow of air into the air intake manifold, whereby said flow of air passes through the reed valve block assembly prior to mixing with fuel from the fuel line means, and wherein air flows out of said reed valve block assembly at an outlet thereof which is generally adjacent to the outlet opening of said fuel injector assembly, said outlet opening of the fuel injector assembly being within the crankcase of the internal combustion engine.

* * * * *